US011555316B2

(12) United States Patent
Kelly et al.

(10) Patent No.: US 11,555,316 B2
(45) Date of Patent: Jan. 17, 2023

(54) ANCHOR AND CLUTCH ASSEMBLY

(71) Applicant: Meadow Burke, LLC, Riverview, FL (US)

(72) Inventors: David L. Kelly, Sacramento, CA (US); Michael J. Recker, Palmetto, FL (US)

(73) Assignee: Meadow Burke, LLC, Riverview, FL (US)

( * ) Notice: Subject to any disclaimer, the term of this patent is extended or adjusted under 35 U.S.C. 154(b) by 0 days.

(21) Appl. No.: 17/223,906

(22) Filed: Apr. 6, 2021

(65) Prior Publication Data

US 2021/0222444 A1 Jul. 22, 2021

Related U.S. Application Data

(62) Division of application No. 16/359,668, filed on Mar. 20, 2019, now Pat. No. 10,968,645.

(60) Provisional application No. 62/645,352, filed on Mar. 20, 2018.

(51) Int. Cl.

| | |
|---|---|
| ***E04G 21/14*** | (2006.01) |
| ***B66C 1/66*** | (2006.01) |
| ***E04B 1/41*** | (2006.01) |
| ***E04C 5/12*** | (2006.01) |

(52) U.S. Cl.

CPC ..... *E04G 21/142* (2013.01); *B66C 1/666* (2013.01); *E04B 1/4142* (2013.01); *E04C 5/12* (2013.01)

(58) Field of Classification Search

CPC ..... E04G 21/142; B66C 1/666; E04C 5/12; E04B 1/41; E04B 1/4142

See application file for complete search history.

(56) References Cited

U.S. PATENT DOCUMENTS 361,927 A ‡ 4/1887 Cartwright ..... B66C 1/666 294/89
956,938 A ‡ 5/1910 Ciardelli ..... B66C 1/666 294/89
2,099,116 A 11/1937 Kalmach (Continued)

FOREIGN PATENT DOCUMENTS

EP 0568934 11/1993
EP 0568934 A2 ‡ 11/1993 ..... B66C 1/666

OTHER PUBLICATIONS

Official Action for U.S. Appl. No. 16/359,668, dated Jan. 6, 2020 6 pages Restriction Requirement.

(Continued)

*Primary Examiner* — Rodney Mintz
(74) *Attorney, Agent, or Firm* — Sheridan Ross P.C.

(57) ABSTRACT

Anchors, clutches, and lifting systems are described herein that increase the size of a shear cone within a precast concrete panel without using multiple clutches and without increasing the complexity of the lift system. A shear cone is the volume within the panel that the anchor and clutch pull on when orienting and positioning the precast concrete panel. Anchors described herein encompass a larger volume of the panel in different ways to produce a larger shear cone. Similarly, the clutches described herein have features that allow a clutch to accommodate the improved anchors. As a result, the anchors, clutches, and lifting systems provide a larger shear cone in the panel to increase the load capacity of the lifting system and reduce the likelihood of failure.

20 Claims, 9 Drawing Sheets

(56) References Cited

U.S. PATENT DOCUMENTS 2,886,370 A ‡ 5/1959 Liebert ..... B28B 23/005 294/89
3,798,856 A 3/1974 Gloskowski
3,883,170 A ‡ 5/1975 Fricker ..... E04G 21/142 294/82.35
4,083,156 A 4/1978 Tye
4,173,856 A ‡ 11/1979 Fricker ..... E04G 21/142 248/499
4,367,892 A ‡ 1/1983 Holt ..... B66C 1/666 294/82.31
4,383,674 A 5/1983 Fricker
4,437,642 A 3/1984 Holt
4,615,554 A 10/1986 Schilla et al.
4,627,198 A ‡ 12/1986 Francies, III ..... B66C 1/666 264/256
4,634,164 A 1/1987 Fricker
4,671,554 A 6/1987 Lancelot
4,700,979 A 10/1987 Courtois et al.
4,703,595 A 11/1987 Zipf et al.
4,769,960 A 9/1988 Zipf et al.
4,807,843 A 2/1989 Courtois et al.
4,821,994 A 4/1989 Fricker
4,872,634 A 10/1989 Gillaspy et al.
4,930,269 A ‡ 6/1990 Kelly ..... B66C 1/666 294/82.35
5,094,047 A 3/1992 Kelly et al.
5,155,954 A ‡ 10/1992 Roire ..... E04G 15/04 249/190
5,244,243 A ‡ 9/1993 Grayson ..... B66C 1/666 294/82.35
5,535,979 A 7/1996 Ellis-Callow
5,580,115 A 12/1996 Jessen
5,588,263 A ‡ 12/1996 Kelly ..... E04G 5/04 52/125.4
5,651,911 A 7/1997 Pennypacker
D392,752 S ‡ 3/1998 Kelly ..... D25/133
5,735,563 A ‡ 4/1998 Wood ..... B66C 1/66 294/215
6,082,700 A 7/2000 Lancelot, III et al.
6,092,849 A 7/2000 Zambelli et al.
6,142,546 A ‡ 11/2000 Hansort ..... B66C 1/666 294/82.35
6,152,509 A 11/2000 Hansort
6,185,897 B1 ‡ 2/2001 Johnson ..... E04B 1/41 52/582.1
6,260,900 B1 7/2001 Scott
6,341,452 B1 1/2002 Bollinghaus
6,513,847 B2 ‡ 2/2003 Harris ..... B66C 1/66 294/63.1
6,647,674 B1 ‡ 11/2003 Lancelot, III ..... E04G 21/142 294/82.17
6,668,506 B2 ‡ 12/2003 Snauwaert ..... E01C 5/08 52/582.1
6,688,049 B2 ‡ 2/2004 Sanftleben ..... E04G 15/04 294/89
6,769,663 B2 ‡ 8/2004 Kelly ..... B28B 23/0056 249/170
6,854,232 B2 ‡ 2/2005 Snauwaert ..... E01C 5/08 52/367
7,127,859 B2 ‡ 10/2006 Domizio ..... B28B 23/005 52/576
7,380,849 B2 ‡ 6/2008 Mongan ..... B66C 1/36 294/81.5
7,905,063 B2 ‡ 3/2011 Kelly ..... B66C 1/666 52/125.5
7,950,190 B2 5/2011 Schulze
8,291,649 B2 ‡ 10/2012 Kelly ..... B66C 1/666 52/125.5
8,353,133 B2 ‡ 1/2013 Arteon ..... B66C 1/666 52/125.5
8,826,605 B2 9/2014 Recker et al.
8,959,847 B2 ‡ 2/2015 Recker ..... B66C 1/666 52/125.5
9,279,245 B2 ‡ 3/2016 Garot ..... E04B 1/4121
10,968,645 B2 * 4/2021 Kelly ..... E04B 1/4142
2002/0192018 A1 ‡ 12/2002 Snauwaert ..... E04B 1/41 403/286
2003/0101678 A1 ‡ 6/2003 Snauwaert ..... E01C 5/08 52/712
2006/0248811 A1 ‡ 11/2006 Hansort ..... E04G 15/04 52/122.1
2007/0056242 A1 ‡ 3/2007 Sample ..... E04B 1/41 52/698
2009/0320386 A1 12/2009 Mackay
2010/0011678 A1 ‡ 1/2010 Kelly ..... B66C 1/666 52/125.5
2010/0058677 A1 ‡ 3/2010 Arteon ..... E04G 21/142 52/122.1
2011/0000148 A1 ‡ 1/2011 Arteon ..... E04G 21/142 52/125.5
2011/0041422 A1 ‡ 2/2011 Kelly ..... B66C 1/666 52/125.5
2012/0073170 A1 3/2012 Boltz et al.
2013/0340357 A1 ‡ 12/2013 Recker ..... B66C 1/666 52/125.5
2015/0013264 A1 ‡ 1/2015 Garot ..... E04B 1/4157 52/699
2019/0003192 A1 ‡ 1/2019 Arteon ..... E04C 5/12
2019/0292800 A1 * 9/2019 Kelly ..... E04G 21/142

OTHER PUBLICATIONS

Official Action for U.S. Appl. No. 16/359,668, dated Mar. 23, 2020 10 pages.
Official Action for U.S. Appl. No. 16/359,668, dated Jul. 23, 2020 13 pages.
Notice of Allowance for U.S. Appl. No. 16/359,668, dated Nov. 2, 2020 8 pages.

* cited by examiner
‡ imported from a related application

ANCHOR AND CLUTCH ASSEMBLY

CROSS-REFERENCE TO RELATED APPLICATIONS

This application is a Divisional of and claims the benefit of priority of U.S. patent application Ser. No. 16/359,668 filed on Mar. 20, 2019, now U.S. Pat. No. 10,968,645, which claims priority under 35 U.S.C. § 119(e) to U.S. Provisional Patent Application Ser. No. 62/645,352 filed Mar. 20, 2018, the entire disclosures of which are incorporated herein by reference.

FIELD OF THE INVENTION

Embodiments of the present invention are related to anchors, clutches, and anchor-and- clutch assemblies for connecting a lifting system with a precast concrete panel.

BACKGROUND OF THE INVENTION

Certain pre-installed members for transmitting force and manipulating panels or structures, such as pre-formed concrete panels, are known in the art. Such devices and systems include, for example, the MeadowBurke® Rapid Lift and Super Lift systems. Prior art systems comprise, for example, anchors and lifting clutches as shown and described in U.S. Pat. No. 7,905,063 to Kelly, which is hereby incorporated by reference in its entirety. An anchor is provided in the panel and a lifting system with a lifting clutch selectively connects to the anchor for aiding in manipulation of the panel. Such manipulation includes lifting, orienting, and positioning the panel, which is facilitated through features and devices as shown and described herein.

One issue with prior art anchors and lifting clutches is a limited shear cone of the precast concrete panel. The concrete shear cone is the portion of concrete around the insert/anchor that fails due to the concrete's inability to contain the stresses of the applied load. Generally, the shear cone starts at the distal ends of the anchor and expands toward the surface of the precast concrete panel. Another issue is that the solution of multiple anchors and multiple lifting clutches to distribute forces increases the complexity of the precast concrete panel and lifting system, and thus, increases costs and potential sources of failure.

SUMMARY OF THE INVENTION

The above shortcomings and other needs are addressed by the various embodiments and configurations of the present invention. It is an objective of the present invention to provide anchor-and-clutch assemblies that draw from a larger shear cone in a precast concrete panel to increase the overall lifting capacity of the anchor-and-clutch assembly and prevent structural failure of the panel during assembly.

One aspect of embodiments of the present invention is to provide an anchor with multiple bars, specifically an anchor comprising two bars to increase the volume encompassed by the anchor. Therefore, the anchor can pull on a larger shear cone within the panel. In some embodiments, a plurality of bars are bent and positioned adjacent to each other but unconnected in order to provide the anchor for the lifting clutch. In various embodiments, a plurality of bars are welded together along longitudinal lengths of the bars that are positioned in the lifting clutch. In some embodiments, the bars are partially bent and shaped and positioned in the lifting clutch. Then, the bars are bent where they are positioned in the lifting clutch, and the bars are welded along a longitudinal length. Ends of the arms can be deflected at perpendicular angles from the remaining portions of the arms to provide a more secure attachment to the precast concrete panel.

One aspect of embodiments of the present invention is to provide a clutch engagement portion of the anchor to increase the size of the shear cone. The clutch engagement portion of the anchor is typically the bent portion of the anchor that resides in the lifting clutch when the assembly is fully connected and bearing the load of the precast concrete panel. In some embodiments, the clutch engagement portion is a rounded portion of the bar with a constant radius of curvature. In various embodiments, the clutch engagement portion is square bar that provides additional rigidity. In some embodiments, the clutch engagement portion has a straight part that extends in a width direction to increase the size of the shear cone.

One aspect of the present invention is to provide a lifting clutch that has a wider body in a width direction to accommodate various anchors, including the novel anchors described herein. The lifting clutch has larger wing surfaces that provides space for increased anchor size so that the size of the shear cone can be increased. For instance, the clutch can accommodate an anchor with two bars where the center portions of the bars are positioned adjacent to each other, and the center portions define a single aperture through which the clutch engages the anchor. Thus, the shear cone is increased while the lifting system has only a single clutch.

One further aspect of the present invention is to provide a lifting clutch that can receive multiple clutch engagement portions of an anchor. The anchor may have multiple bars where each bar defines two or more apertures through which a clutch engages the anchor. Therefore, two adjacent bars can form a first aperture and a second aperture through which the clutch engages the anchor. The clutch may have a pin with two parts where each part extends through one aperture defined by the bars of the anchor. In addition, the clutch may have multiple recesses on a bottom portion to receive multiple clutch engagement portions or may have a single continuous recess.

One particular embodiment is a system for orienting and positioning a precast concrete panel, comprising a precast concrete panel having a surface with a void extending from the surface into the precast concrete panel; an anchor partially positioned in the void, and the anchor having a first bar with a first plurality of arms extending into the precast concrete panel and having a second bar with a second plurality of arms extending into the precast concrete panel, wherein at least one arm of the first plurality of arms and at least one arm of the second plurality of arms form a bar angle of at least 15 degrees relative to each other, and wherein the first bar and the second bar form a single aperture within the void of the precast concrete panel; a clutch having a top portion with an opening, and the top portion having a width, the clutch having a bottom portion with a recess configured to receive the first and second bars of the anchor, and the bottom portion having a width that is larger than the width of the top portion; and a pin extending through the opening in the clutch, and the pin configured to rotate within a volume in the clutch to selectively pass through the single aperture of the bars and selectively secure the clutch to the anchor.

In some embodiments, the first plurality of arms has two arms that are oriented at a first angle relative to each other, and the second plurality of arms has two arms that are oriented at a second angle relative to each other, wherein the first angle and the second angle are each between 15 and 60 degrees. In various embodiments, a top surface of the top portion has a first radius of curvature, and a bottom surface of the bottom portion has a second radius of curvature, and the second radius of curvature is larger than the first radius of curvature.

In some embodiments, a center portion of the first bar defines a first clutch engagement portion having a first radius of curvature and a second clutch engagement portion having a second radius of curvature, wherein the first clutch engagement portion at least partially defines the single aperture, and the second clutch engagement portion at least partially defines a second, single aperture. In various embodiments, the first clutch engagement portion and the second clutch engagement portion are positioned in the recess, and wherein the pin extends through the opening and a second opening in the top portion to rotate within the volume in the clutch to selectively pass through the single aperture and the second, single aperture and selectively secure the clutch to the anchor.

In some embodiments, the first plurality of arms extends from a center portion of the first bar, and the second plurality of arms extends from a center portion of the second bar, wherein the center portions define the single aperture. In various embodiments, the center portion of the first bar and the center portion of the second bar are welded together. In some embodiments, the center portion of the first bar forms an angle with at least one arm of the first plurality of arms that is half of the bar angle, and the center portion of the second bar forms an angle with at least one arm of the second plurality of arms that is half of the bar angle. In various embodiments, the clutch has a first wing and a second wing extending outwardly to define the width of the bottom portion.

Another particular embodiment is an anchor for providing an increased shear cone in a precast concrete panel, comprising a first bar having a first plurality of arms extending from a first center portion, wherein the first plurality of arms has two arms that are oriented at a first angle relative to each other, and the first angle is between approximately 15 and 60 degrees; and a second bar having a second plurality of arms extending from a second center portion, wherein the second plurality of arms has two arms that are oriented at a second angle relative to each other, and the second angle is between approximately 15 and 60 degrees, wherein at least one arm of the first plurality of arms and at least one arm of the second plurality of arms form a bar angle of at least 15 degrees relative to each other; and a common aperture at least partially defined by the first center portion and the second center portion.

In various embodiments, the first center portion has a first radius of curvature and the second center portion has a second radius of curvature. In some embodiments, the first center portion forms an angle with at an arm from the first plurality of arms that is half of the bar angle, and the second center portion forms an angle with an arm of the second plurality of arms that is half of the bar angle. In various embodiments, the first center portion comprises a first clutch engagement portion having a first radius of curvature and a second clutch engagement portion having a second radius of curvature, wherein the first clutch engagement portion defines the common aperture with the second center portion, and the second clutch engagement portion defines a second common aperture with the second center portion. In some embodiments, the first center portion comprises a spacing section between the first clutch engagement portion and the second clutch engagement portion.

A further particular embodiment is a lifting clutch for selectively engaging and receiving a lifting anchor embedded in a precast concrete panel, comprising a top portion at least partially defining an opening, wherein a top surface of the top portion has a first radius of curvature, and the top portion has a width; a bottom portion defining a recess configured to receive an anchor, wherein a bottom surface of the bottom portion has a second radius of curvature, and the second radius of curvature is larger than the first radius of curvature; and a first wing and a second wing of the bottom portion extend outwardly to define a width of the bottom portion that is larger than the width of the top portion.

In various embodiments, the second radius of curvature is at least 10% larger than the first radius of curvature, and the width of the bottom portion is at least 10% larger than the width of the top portion. In some embodiments, the clutch further comprises a pin extending through the opening in the clutch, the pin positioned in a volume at least partially defined by the top portion and the bottom portion, wherein the pin is configured to rotate between an open position to allow an anchor to be positioned in the recess and a closed position to secure an anchor in the recess. In various embodiments, the clutch further comprises an aperture extending through at least one of the width of the bottom portion or the width of the top portion, and the aperture configured to receive a bail to secure the pin within the volume. In some embodiments, the recess is a single recess in the bottom portion.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1A:
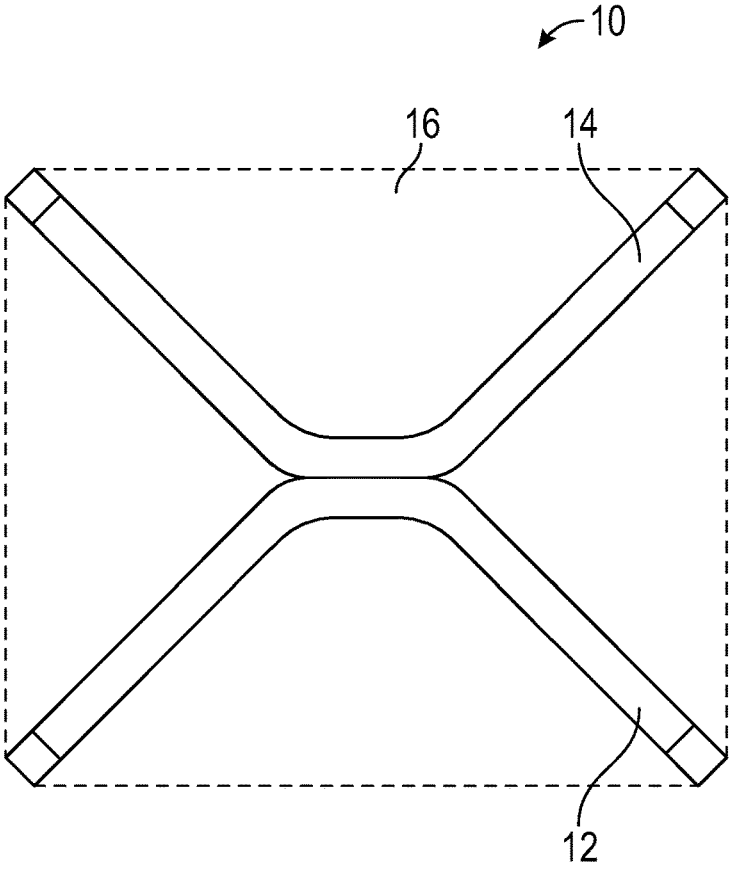
FIG. 1A is a top plan view of an anchor in accordance with one embodiment of the present invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Anchor |
| 12 | First Bar |
| 14 | Second Bar |
| 16 | Encompassed Volume |
| 18 | First Arm |
| 20 | Second Arm |
| 22 | Center Portion |
| 24 | First End |
| 26 | Second End |
| 28 | Precast Concrete Panel |
| 30 | Void |
| 31 | Common Aperture |
| 32 | Shear Cone |
| 34 | Arm Angle |
| 36 | Bar Angle |
| 38 | Bridge Member |
| 40 | First Clutch Engagement Portion |
| 42 | Second Clutch Engagement Portion |
| 44 | Clutch Angle |
| 46 | Spacing Portion |
| 48 | Spacing Angle |
| 50 | Second Clutch Radius |
| 52 | Anchor Height |
| 54 | Clutch Offset |
| 56 | Anchor Length |
| 58 | Combined Bar Thickness |
| 60 | Bar Thickness |
| 62 | Anchor Width |
| 64 | Clutch |
| 66 | Top Portion |
| 68 | Bottom Portion |
| 70 | Aperture |
| 72 | First Radius of Curvature |
| 74 | Second Radius of Curvature |
| 76 | Recess |
| 78 | Top Width |
| 80 | First Wing |
| 82 | Second Wing |
| 84 | Bottom Width |
| 86 | Volume |
| 88 | Opening |
| 90 | Lifting System |
| 92 | Pin |
| 94 | Bail |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict anchors and lifting clutches, and methods and systems for using the same, the present invention is not limited to these embodiments.

Figure 1B:
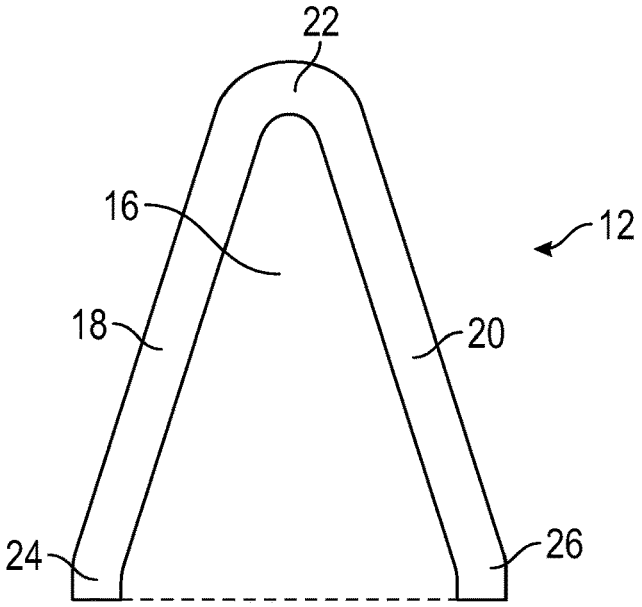
FIG. 1B is a side elevation view of the anchor in FIG. 1A in accordance with one embodiment of the present invention.
Figure 1C:
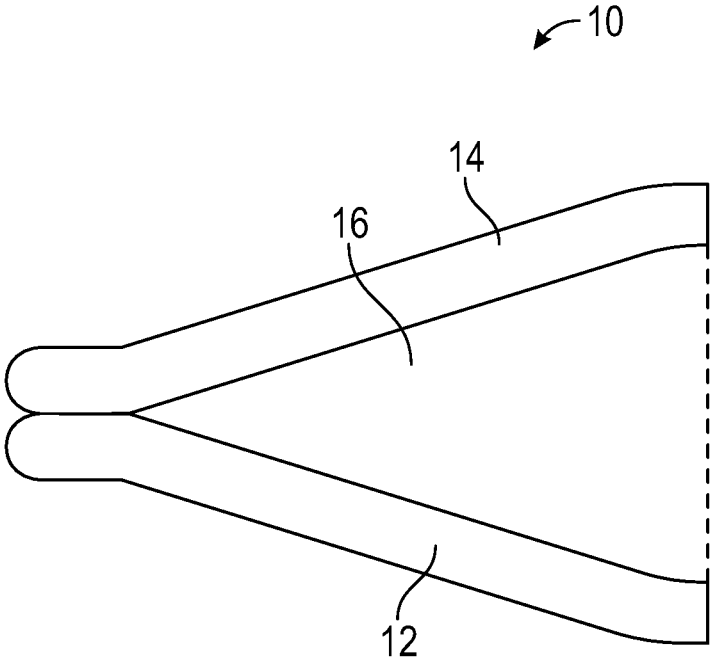
FIG. 1C is another side elevation view of the anchor in FIG. 1A in accordance with one embodiment of the present invention.

Now referring to FIGS. 1A-1E, various views of an anchor 10 that can be embedded in a precast concrete panel are provided. A clutch of a lifting system can selectively connect to the anchor 10 to orient and position the precast concrete panel. FIGS. 1A, 1B, and 1C show a top plan view, a front elevation view, and a side elevation view, respectively, of the anchor 10. The anchor 10 comprises a first bar 12 and a second bar 14 that extend in three dimensions to define an enclosed volume 16. The bars 12, 14 extend into concrete and enclose a volume of concrete 16 to secure the anchor 10 within the concrete. In prior art embodiments with a single bar, an anchor could enclose only a volume with the thickness of the single bar. In contrast, the enclosed volume 16 depicted in FIGS. 1A-1C is several times larger, and the larger enclosed volume 16 results in a larger shear cone in a precast concrete panel.

As shown in FIG. 1B, the first bar 12 has a first arm 18 and a second arm 20 that are joined at a center portion 22, and each arm 18, 20 has a respective end 24, 26 that can be deflected at an angle relative to the remaining portions of the arms 18, 20 to provide a more secure connection between the first bar 12 of the anchor 10 and the precast concrete panel in which the anchor 10 is positioned. The center portion 22 can be curved and positioned in a void of the precast concrete panel, and the center portion 22 can serve as a clutch engagement portion that is positioned in a clutch of a lifting system that orients and positions the precast concrete panel.

Initially, the bars 12, 14 can be a single, straight bar that is shaped and bent into the configuration shown. The bars 12, 14 may be joined at the center portions 22 using, for example, a weld. The bars 12, 14 can be joined prior to or after selective connection with a lifting clutch. Further, in some embodiments, the bars 12, 14 are provided in a lifting clutch without welding. The bars 12, 14 in FIGS. 1A-1C are ⅜ inch×¾ inch bent bars, but it will be appreciated that embodiments of the present invention can include bars of various sizes and shapes.

Figure 1D:
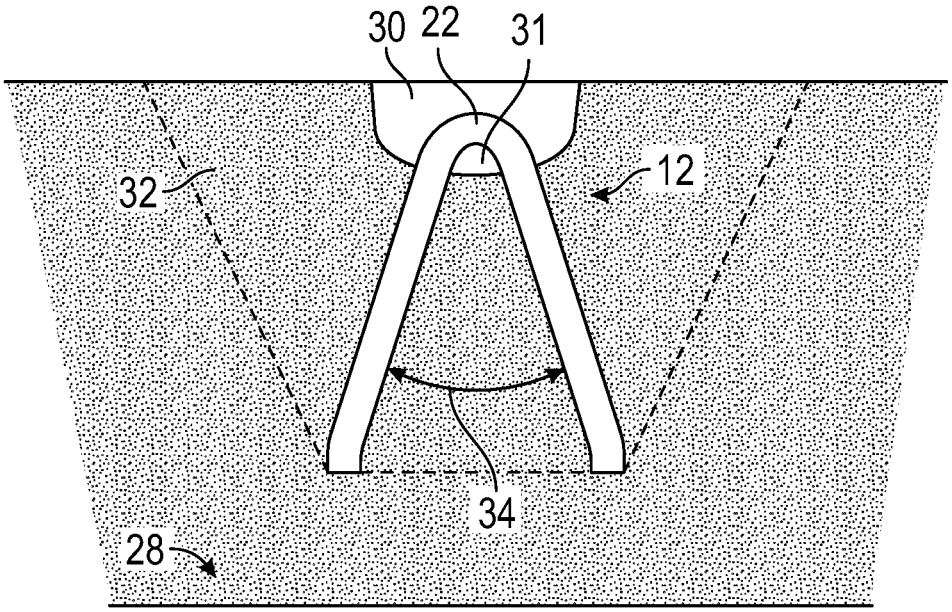
FIG. 1D is a partial cross-sectional view of the anchor in FIG. 1A within a precast concrete panel in accordance with one embodiment of the present invention.
Figure 1E:
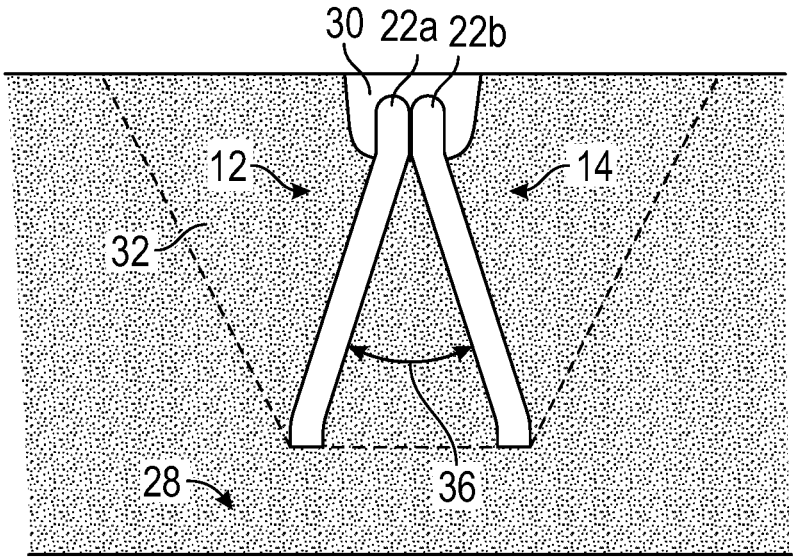
FIG. 1E is another partial cross-sectional view of the anchor in FIG. 1A within a precast concrete panel in accordance with one embodiment of the present invention.

Now referring to FIGS. 1D and 1E, a front elevation view and a side elevation view, respectively, of the anchor 10 positioned in a precast concrete panel 28 are provided. As shown in FIG. 1D, this view shows the first bar 12 of the anchor positioned in the precast concrete panel 28, and a center portion 22 of the first bar 12 extends into a void 30 of the precast concrete panel. The void 30 can be formed by a structure such as a void former that surrounds the center portion 22 and excludes concrete as concrete is poured into a form and cures around the anchor. The void former can then be removed from the precast concrete panel, and a clutch of a lifting system can then enter the void 30 and selectively connect to the center portion 22. Specifically, the clutch can extend through an aperture 31 that is defined by the center portions of the bars. The center portions are positioned adjacent and/or side by side to define a single, common aperture 31. Therefore, a single clutch can selectively connect to a single anchor that provides an increased shear cone.

FIG. 1D shows the shear cone 32 that extends upward to a surface of the precast concrete panel 28. From this perspective the shear cone 32 extends from the distal ends of the bar 12 and upward and outward to the surface of the precast concrete panel 28. Also depicted is an arm angle 34 between the arms of the first bar 12. In some embodiments, the arm angle 34 is between approximately 15 and 60 degrees. In various embodiments, the arm angle 34 is approximately 45 degrees.

FIG. 1E is a side elevation view of the anchor embedded in a precast concrete panel 28. This partial cross sectional view shows the two bars 12, 14 of the anchor extending into the precast concrete panel 28, and a shear cone 32 extending upwardly and outwardly from distal ends of the bars 12, 14 to the surface of the precast concrete panel 28. From this view, it is apparent that the use of two bars 12, 14 increases the size of the shear cone 32 to encompass a larger volume than if the anchor had only a single bar. As a result of the large shear cone 32, a clutch and lifting system pulling on the anchor will pull on a larger volume of the precast concrete panel 28. This allows the lifting system to bear a precast concrete panel with a larger mass and weight, and this also reduces the likelihood of the structure of the precast concrete panel failing as the lifting system orients and positions the precast concrete panel 28. The arms of the bars 12, 14 can be oriented at a bar angle 36. In some embodiments, the bar angle 36 is between approximately 15 and 60 degrees. In various embodiments, the bar angle 36 is approximately 45 degrees. It will be appreciated that the center portion 22*a*, 22*b* of each bar 12, 14 can form an angle to the remaining portions of the bar 12, 14 that is half of the bar angle 36 in some embodiments.

Figure 2A:
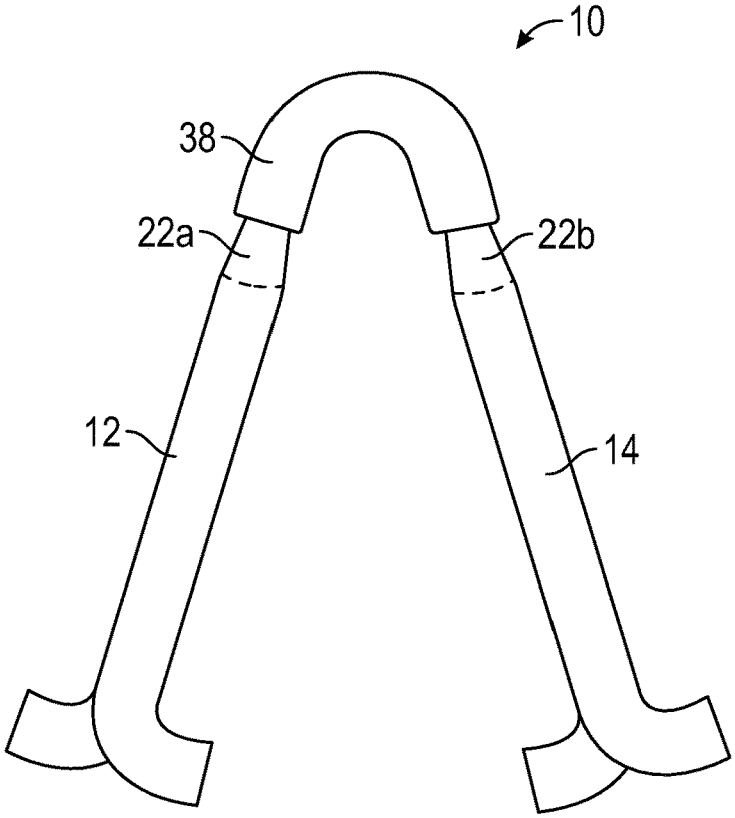
FIG. 2A is a front elevation view of another anchor in accordance with one embodiment of the present invention.
Figure 2B:
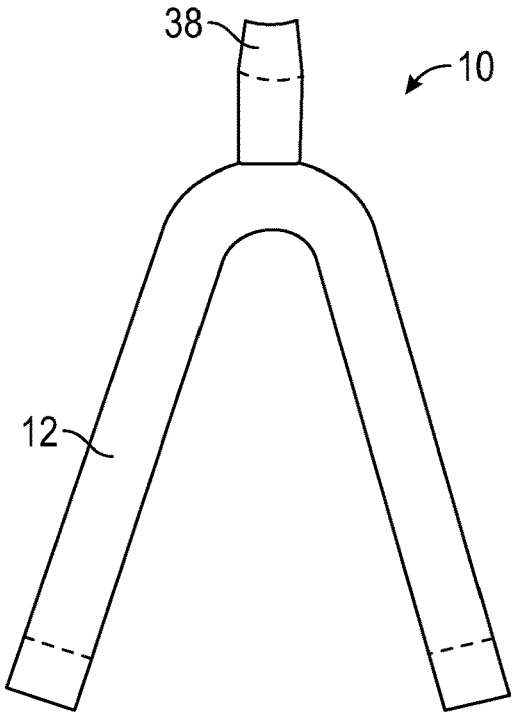
FIG. 2B is a side elevation view of the anchor in FIG. 2A in accordance with one embodiment of the present invention.

Now referring to FIGS. 2A and 2B, a front elevation view and a side elevation view of an anchor 10 are provided, respectively. In this embodiment, two bars 12, 14 are joined by a bridge member 38 that can be welded to center portions 22*a*, 22*b* of each of the bars 12, 14. The bridge member 38 in this embodiment is a ¾ inch square bar, but it will be appreciated that the bridge member 38 can include bars of various sizes and shapes. The bridge member 38 is positioned in a lifting clutch and the bars 12, 14 provide an increased shear cone size to increase the load capacity of the anchor-and-clutch assembly.

Figure 3:
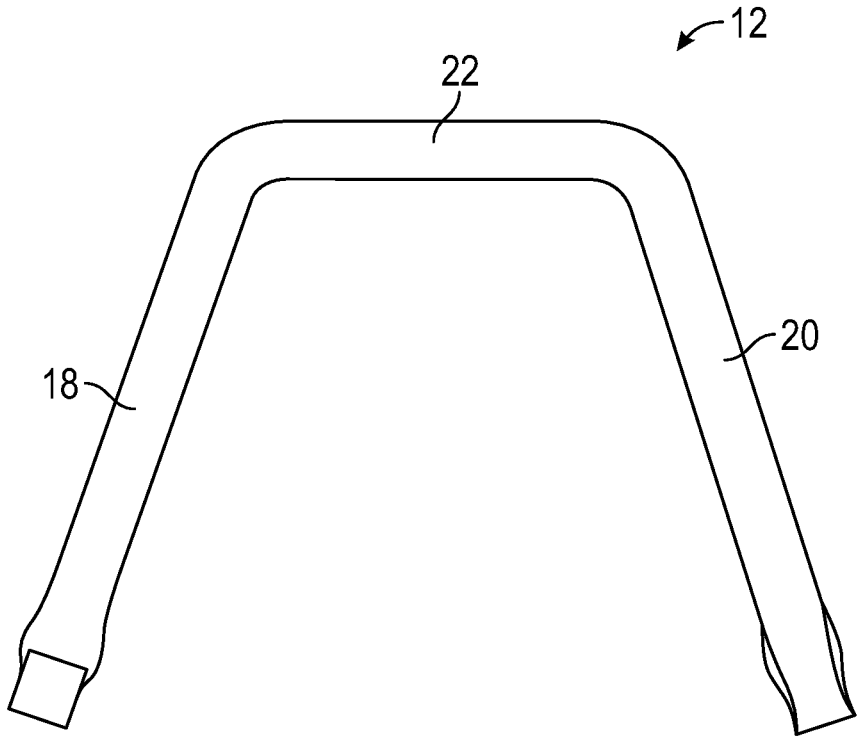
FIG. 3 is a front elevation view of a further anchor in accordance with one embodiment of the present invention.

Now referring to FIG. 3, a front elevation view of a bar 12 is provided. In this embodiment, the bar 12 has a first arm 18 and a second arm 20 that are joined by a center portion 22. However, the center portion 22 does not have a constant radius of curvature. Rather, the center portion 22 has a first radius of curvature at the connection with the first arm 18, a second radius of curvature at the connection with the second arm 20, and the center portion 22 extends along a length dimension. This center portion 22 is substantially straight and defines a larger shear cone that increases the load capacity of the anchor-and-clutch assembly. The center portion 22 can extend between approximately 1 and 8 inches in some embodiments. In various embodiments, the center portion 22 is approximately 3 inches. The bar 12 can be ⅝ inch or ¾ inch square bar, but it will be appreciated that the bar 12 can be various sizes and shapes.

Figure 4A:
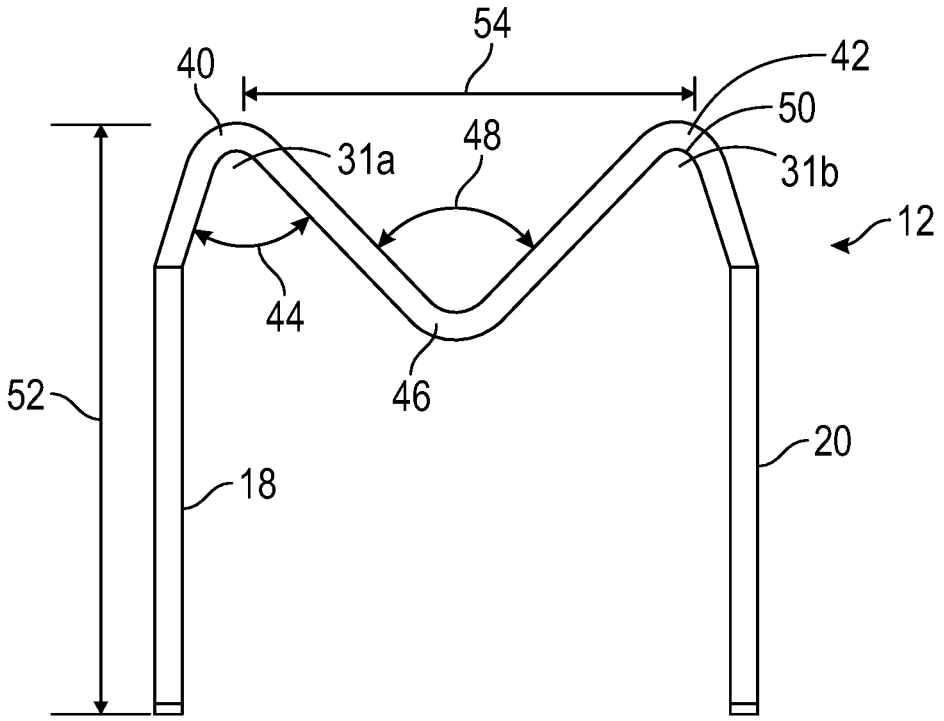
FIG. 4A is a front elevation view of yet another anchor in accordance with one embodiment of the present invention.
Figure 4B:
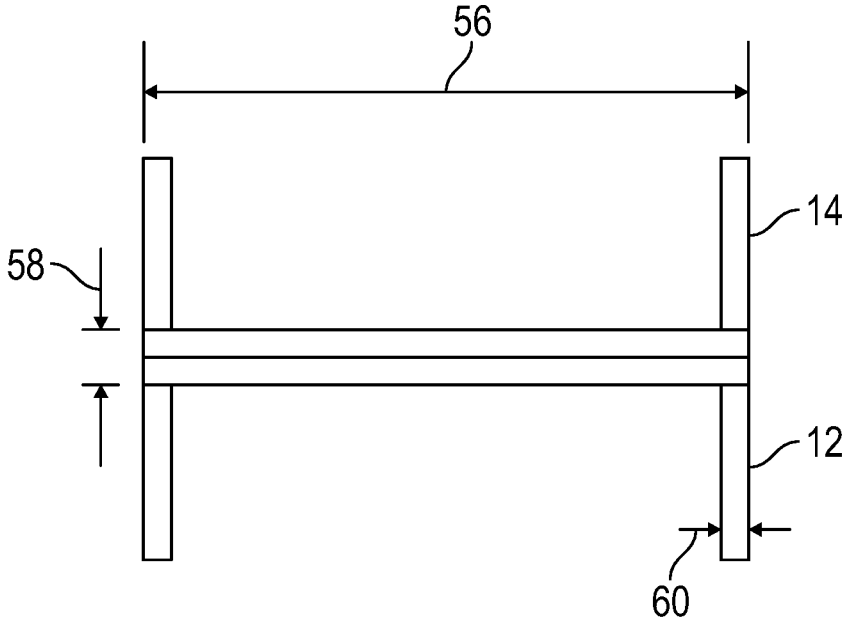
FIG. 4B is a top plan view of the anchor in FIG. 4A in accordance with one embodiment of the present invention.
Figure 4C:
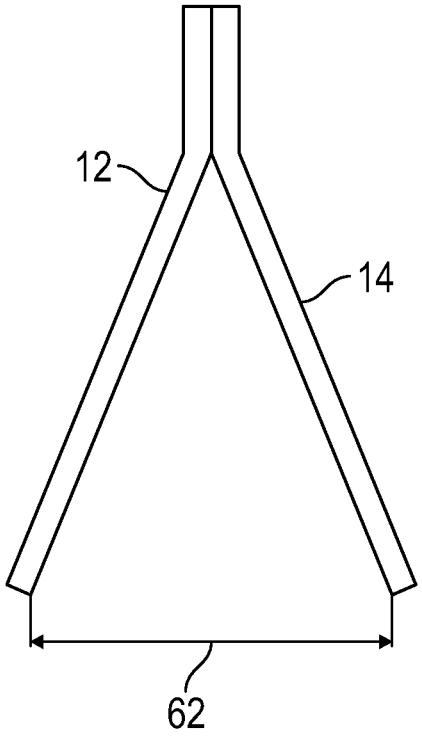
FIG. 4C is a side elevation view of the anchor in FIG. 4A in accordance with one embodiment of the present invention.

Now referring to FIGS. 4A-4C, various views of an anchor are provided. In this embodiment, the anchor comprises a first bar 12 and a second bar 14, and each bar 12, 14 has a first arm 18 and a second arm 22 joined by a center portion. The center portion comprises a first clutch engagement portion 40 and a second clutch engagement portion 42 joined by a spacing portion 46. The clutch engagement portions 40, 42 may be partially positioned in one or more voids formed in a precast concrete panel. The spacing portion 46 may be partially embedded within the concrete of the panel to provide a more secure connection between the anchor and the panel.

The first engagement portion 40 of the first bar 12 defines a first common aperture 31*a* with a corresponding engagement portion of the other bar, and the second engagement portion 42 of the first bar 12 defines a second common aperture 31*b* with a corresponding engagement portion of the other bar. A clutch, as described below with respect to FIG. 6, may have a pin that has two parts, where each part selectively extends through one common aperture 31*a*, 31*b* to selectively connect the clutch to the anchor.

In this embodiment, each clutch engagement portion 40, 42 has a two straight parts oriented at a clutch angle 44 that is between approximately 45 and 90 degrees. In various embodiments, the clutch angle 44 is between 60 and 75 degrees. Each clutch engagement portion 40, 42 also defines a radius of curvature 50 that is between 0.1 and 1 inches in some embodiments. In various embodiments, the radius of curvature 50 is approximately 0.37 inches. The spacing portion 46 has parts that form a spacing angle 48 that is between approximately 45 and 135 degrees in some embodiments. In various embodiments, the spacing angle 48 is approximately 90 degrees. In addition, an anchor height 52 is between approximately 4 and 24 inches in some embodiments. In various embodiments, the anchor height 52 is approximately 8 inches. A clutch offset 54 between the peaks of the two clutch engagement portions 40, 42 is between 2 and 24 inches in some embodiments. In various embodiments, the clutch offset 54 is approximately 6 inches. Dimensions of the anchor are provided in inches, and angles between various portions of the anchor are provided. It will be appreciated that these dimensions and angles are exemplary in nature and are not to be understood as limiting in nature. The term approximately can indicate a less than 10% relative difference.

FIG. 4B is a top plan view of the anchor with the first and second bars 12, 14. A length of the anchor 56 is between approximately 6 and 24 inches in some embodiments. In various embodiments, the anchor length 56 is approximately 8.23 inches. A combined bar thickness 58 at the center portions of the bars 12, 14 is between approximately 0.1 and 4 inches in some embodiments. In various embodiments, the combined thickness 58 is approximately 0.75 inches. A thickness 60 of an individual bar 12, 14 is between approximately 0.1 and 2 inches in some embodiments. In various embodiments, the thickness 60 is approximately 0.38 inches. FIG. 4C shows a side elevation view of the bars 12, 14. A width between distal ends of the bars 12, 14 or anchor width 62 is between approximately 2 and 12 inches in some embodiments. In various embodiments, the anchor width 62 is approximately 4.75 inches.

Figure 5A:
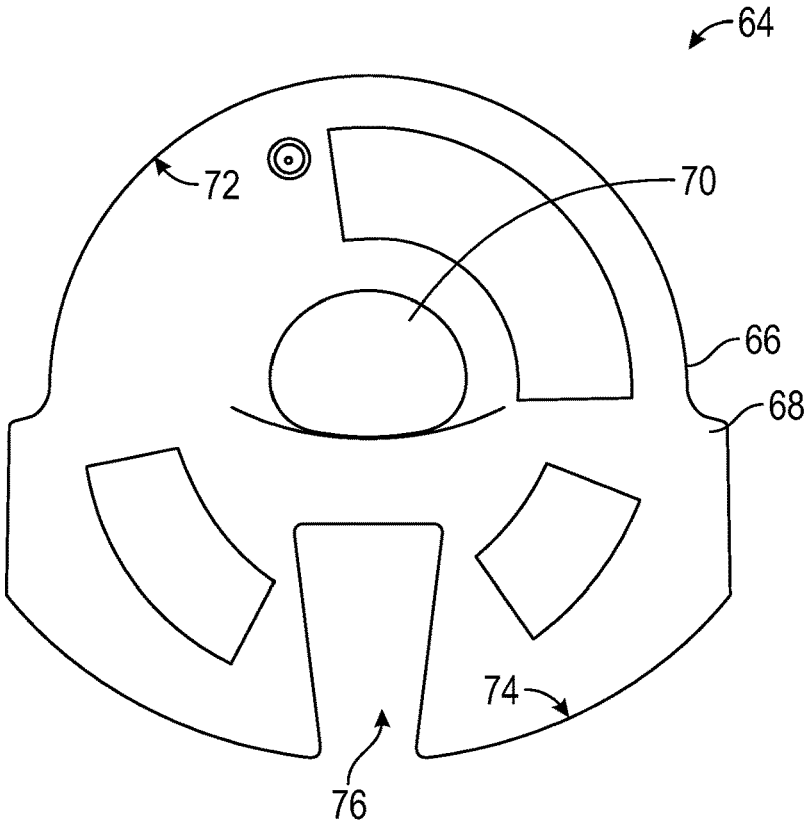
FIG. 5A is a front elevation view of a lifting clutch in accordance with one embodiment of the present invention.
Figure 5B:
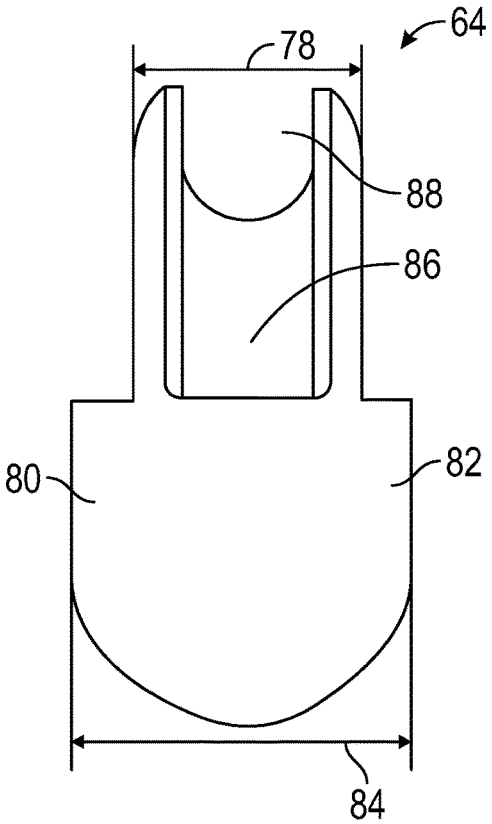
FIG. 5B is a side elevation view of the lifting clutch in FIG. 5A in accordance with one embodiment of the present invention.

Now referring to FIGS. 5A and 5B, a front elevation view and a side elevation view of a lifting clutch 64 are provided, respectively. The lifting clutch 64 can be part of a lifting system that orients and positions a precast concrete panel, and the lifting clutch 64 can selectively connect to an anchor embedded in the panel. The lifting clutch 64 has a top portion 66 and a bottom portion 68. The top portion 66 can have a surface that is defined by a first radius of curvature 72, and the bottom portion 68 can have a surface that is defined by a second radius of curvature 74. In some embodiments, the second radius of curvature 74 is larger than the first radius of curvature 72 to provide an increased area for a larger recess to receive a larger anchor. For instance, the clutch 64 may accommodate an anchor that has two bars positioned adjacent to each other, and an engagement portion with a single, common aperture is formed by side-by-side center portions of the two bars. Similarly, the clutch 64 may have only a single recess to receive the large anchor. Further, an aperture 70 may extend through the top portion 66 and/or the bottom portion 68, and the aperture 70 receives a bail of a lifting system, and the bottom portion 68 of the clutch 64 defines a recess 76 that receives the clutch engagement portion of an anchor.

As shown in FIG. 5B, the bottom portion 68 may have a first wing 80 and a second wing 82 that extend outwardly in a width direction. These wings 80, 82 define a bottom width 84 of the bottom portion that is larger than a top width 78 of the top portion. The difference in widths 78, 84 of the top and bottom portions and the difference in radiuses of curvature provide a larger area to receive an anchor. These improvements also allow the lifting clutch 64 to accommodate a wide variety of anchor shapes, including the novel anchors described herein that provide an increased shear cone size in a precast concrete panel.

The radius of curvature of the bottom surface of the lower portion can be increased by at least 10% over the radius of curvature of the top surface of the top portion of the lifting clutch. In some embodiments, the radius of curvature of the bottom surface of the lower portion can be increased by at least 20% over the radius of curvature of the top surface of the top portion of the lifting clutch. In various embodiments, the radius of curvature of the bottom surface of the lower portion can be increased by at least 20% over the radius of curvature of the top surface of the top portion of the lifting clutch. Referring to FIG. 5B, the extended wings can increase the width dimension of the lower portion relative to the top portion of the lifting clutch by at least 10%. In some embodiments, the wings can increase the width dimension of the lower portion relative to the top portion of the lifting clutch by at least 25%. In various embodiments, the wings can increase the width dimension of the lower portion relative to the top portion of the lifting clutch by at least 40%.

In addition, as shown in FIG. 5B, the clutch 64 defines a volume 86 and a top opening 88 to receive a pin. The pin can rotate within the clutch 64 to selectively extend across the recess 76 of the clutch 64 and secure the clutch 64 to an anchor within a precast concrete panel. Operation of a pin is further described in U.S. Pat. No. 7,905,063 to Kelly, which is hereby incorporated by reference in its entirety.

Figure 6:
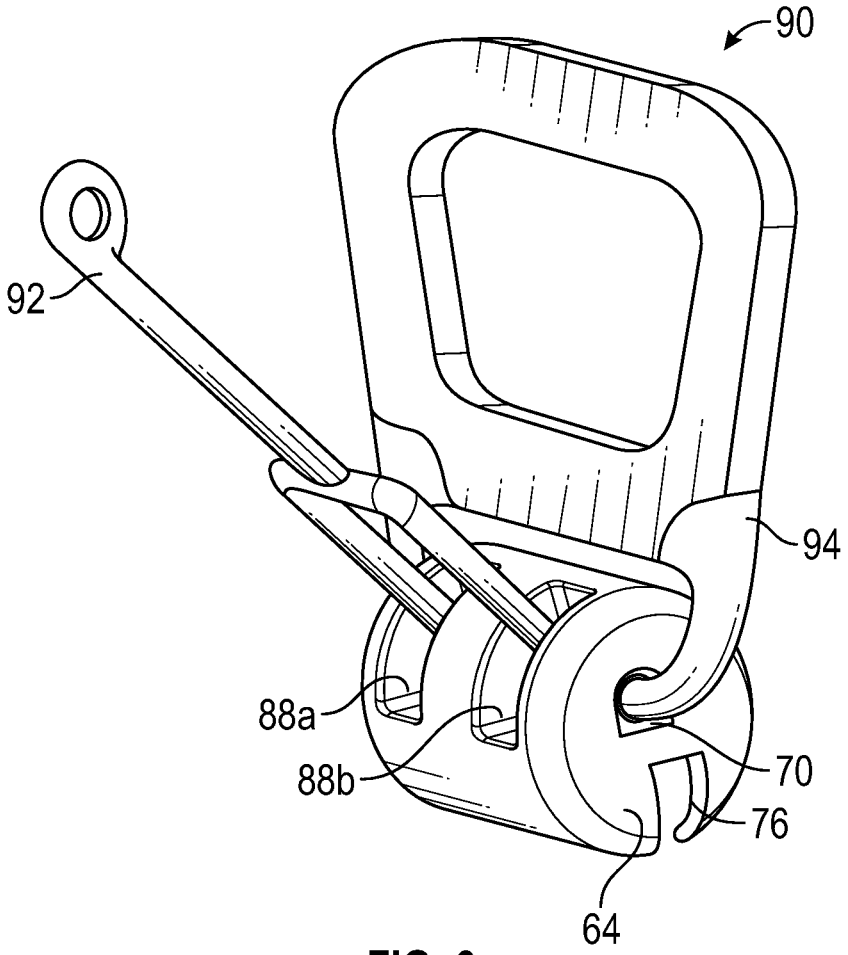
FIG. 6 is a perspective view of another lifting clutch in accordance with one embodiment of the present invention.

Now referring to FIG. 6, a perspective view of a lifting clutch 64 is provided. The lifting clutch 64 comprises a first opening 88*a* and a second opening 88*b* to receive distal ends of a pin 92. The clutch 64 defines a recess 76 that can accommodate two anchors and/or an anchor with two clutch engagement portions as shown in FIGS. 4A-4C. The bail 94 can extend through an aperture 70 in the clutch 64 to join the clutch 64 with other components of the lifting system 90 such as a rope or cable. This clutch 64 accommodates larger anchors embedded in a precast concrete panel, and the larger anchors can produce larger shear cones.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A lifting clutch for selectively engaging and receiving a lifting anchor embedded in a precast concrete panel, comprising:

a top portion at least partially defining an opening, wherein a top surface of said top portion has a first radius of curvature, and a first width;

a bottom portion having opposed first and second planar end surfaces located at distal ends thereof, the bottom portion defining a recess configured to receive the lifting anchor, wherein a first portion of a bottom surface of said bottom portion has a second radius of curvature larger than said first radius of curvature, and wherein at least a second portion of said bottom surface is set at an angle relative to said first portion of said bottom surface; and a first wing and a second wing of said bottom portion extending outwardly to define a second width that is larger than said first width of said top portion, wherein a first outer surface of said first wing and a second outer surface of said second wing are substantially parallel, and wherein the first planar end surface and the second planar end surface are substantially parallel with each other.

2. The lifting clutch of claim 1, wherein said recess is a single recess in said bottom portion.

3. The lifting clutch of claim 1, further comprising:

a pin extending through said opening in said clutch, said pin positioned in a volume at least partially defined by said top portion and said bottom portion, wherein said pin is configured to rotate between an open position to allow the lifting anchor to be positioned in said recess and a closed position to secure the lifting anchor in said recess.

4. The lifting clutch of claim 3, further comprising an aperture extending through at least one of said second width of said bottom portion or said first width of said top portion, and said aperture configured to receive a bail to secure said pin within said volume.

5. The lifting clutch of claim 1, wherein said second radius of curvature is at least 10% larger than said first radius of curvature.

6. The lifting clutch of claim 5, wherein said second radius of curvature is about 20% larger than said first radius of curvature.

7. The lifting clutch of claim 1, wherein said width of said bottom portion is at least 10% larger than said width of said top portion.

8. The lifting clutch of claim 7, wherein said width of said bottom portion is at least 25% larger than said width of said top portion.

9. The lifting clutch of claim 8, wherein said width of said bottom portion is about 40% larger than said width of said top portion.

10. A lifting clutch for selectively engaging and receiving at least one lifting anchor embedded in a precast concrete panel, comprising:

a top portion at least partially defining an opening, wherein said top portion has a first width, wherein said top portion has a top surface with a first radius of curvature;

a bottom portion having opposed first and second planar end surfaces located at distal ends thereof, the bottom portion defining a recess configured to receive multiple portions of the at least one lifting anchor, wherein said bottom portion has a bottom surface with a second radius of curvature that is about 25% larger than said first radius of curvature; and a first wing and a second wing of said bottom portion extending outwardly to define a second width that is larger than said first width of said top portion, wherein a first outer surface of said first wing and a second outer surface of said second wing are substantially parallel, wherein the first planar end surface and the second planar end surface are substantially parallel with each other, and wherein said second width is 10% to about 40% larger than said first width.

11. The lifting clutch of claim 10, wherein said recess is a single recess in said bottom portion.

12. The lifting clutch of claim 10, wherein at least a second portion of said bottom surface at least partially defines said recess and is set at an angle relative to said first portion of said bottom surface.

13. The lifting clutch of claim 10, further comprising:

a pin extending through said opening in said clutch, said pin positioned in a volume at least partially defined by said top portion and said bottom portion, wherein said pin is configured to rotate between an open position to allow the multiple portions of said at least one lifting anchor to be positioned in said recess and a closed position to secure the multiple portions of said at least one lifting anchor in said recess.

14. The lifting clutch of claim 13, further comprising an aperture extending through at least one of said second width of said bottom portion or said first width of said top portion, and said aperture configured to receive a bail to secure said pin within said volume.

15. A lifting clutch for selectively engaging and receiving at least one lifting anchor embedded in a precast concrete panel, comprising:

a top portion at least partially defining at least one opening, wherein a top surface of said top portion has a first radius of curvature, and a first width;

a bottom portion having opposed first and second planar end surfaces located at distal ends thereof, the bottom portion defining a recess configured to receive multiple portions of said at least one lifting anchor, wherein a first portion of a bottom surface of said bottom portion has a second radius of curvature larger than said first radius of curvature, and wherein at least a second portion of said bottom surface is set at an angle relative to said first portion of said bottom surface;

a first wing and a second wing of said bottom portion extending outwardly to define a second width that is larger than said first width of said top portion, wherein a first outer surface of said first wing and a second outer surface of said second wing are substantially parallel, and wherein the first planar end surface and the second planar end surface are substantially parallel with each other; and a pin extending through said at least one opening in said clutch, said pin positioned in a volume at least partially defined by said top portion and said bottom portion, wherein said pin is configured to rotate between an open position to allow the multiple portions of said at least one lifting anchor to be positioned in said recess and a closed position to secure the multiple portions of said at least one lifting anchor in said recess.

16. The lifting clutch of claim 15, said at least one opening including two openings, wherein said pin extends through both of said openings in said clutch.

17. The lifting clutch of claim 15, further comprising an aperture extending through at least one of said second width of said bottom portion or said first width of said top portion, and said aperture configured to receive a bail to secure said pin within said volume.

18. The lifting clutch of claim 15, wherein said recess is a single recess in said bottom portion.

19. The lifting clutch of claim 18, wherein said multiple portions of said at least one lifting anchor are two anchors, and wherein said single recess is configured to simultaneously receive both of said lifting anchors.

20. The lifting clutch of claim 18, wherein said multiple portions of said at least one lifting anchor are two clutch engagement portions of a respective lifting anchor, and wherein said single recess is configured to simultaneously receive said respective lifting anchor at each of said clutch engagement portions.

* * * * *